United States Patent [19]

Markgraf et al.

[11] Patent Number: 4,603,848

[45] Date of Patent: Aug. 5, 1986

[54] SHEET SEPARATOR INCLUDING PASSAGE GAP ADJUSTING MECHANISM FOR SEPARATING SHEETS OF VARIOUS THICKNESSES FROM A STACK OF SHEETS

[75] Inventors: Wilhelm Markgraf, Tennenbronn; Werner Lehmann, Gutach; Rainer Fecker, Furtwangen, all of Fed. Rep. of Germany

[73] Assignee: Mathias Bäuerle GmbH, Fed. Rep. of Germany

[21] Appl. No.: 717,881

[22] Filed: Mar. 29, 1985

[30] Foreign Application Priority Data

Apr. 4, 1984 [DE] Fed. Rep. of Germany ..... 3412574

[51] Int. Cl.[4] ..... B65H 3/52

[52] U.S. Cl. ..... 271/125; 271/263

[58] Field of Search ..... 271/124, 125, 263

[56] References Cited

U.S. PATENT DOCUMENTS

| | | | |
|---|---|---|---|
| 2,670,954 | 3/1954 | Bach | 271/263 |
| 3,593,989 | 7/1971 | Crittenden | 271/263 X |
| 4,132,402 | 1/1979 | Morrison | 271/263 |
| 4,527,793 | 7/1985 | Böttcher | 271/263 |

FOREIGN PATENT DOCUMENTS 2538957 3/1977 Fed. Rep. of Germany .

*Primary Examiner*—Richard A. Schacher

*Attorney, Agent, or Firm*—McGlew and Tuttle

[57] ABSTRACT

A sheet separator for a sheet feeder comprises a friction cylinder which is rotatable for feeding a sheet from a stack of sheets. A retaining member is mounted for radial movement with respect to the friction cylinder. The retaining member has a friction surface which holds back other sheets in the stack and which forms with the friction cylinder a passage gap which is adjusted to the thickness of a sheet to be fed. A carrier is connected to and supports the retaining member. An adjustment mechanism is provided between the carrier and the retaining member for adjusting the passage gap width. A bracket is mounted for radial movement on the carrier and has a contact surface for engaging the friction cylinder or a sheet held in the passage gap. Signal switch is provided in the bracket and is activated by a checking element which is movably mounted to the bracket and engaged with either the carrier or the retaining member. The switch changes state when a selected relative position is established between the retaining member and the contact surface of the bracket. A circuit is connected to the switch for indicating its change in state. The selected position is chosen for establishing the correct passage gap for a sheet of paper to be fed.

18 Claims, 15 Drawing Figures

Fig. 2
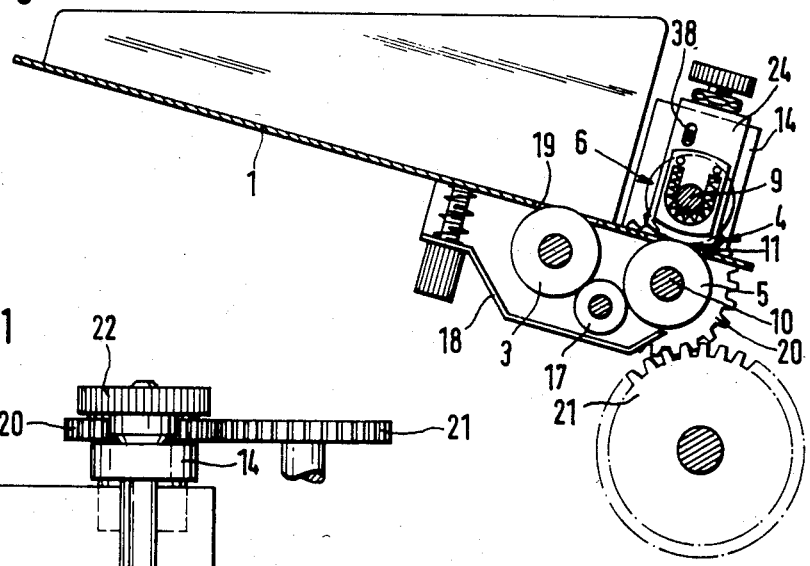
Fig. 1
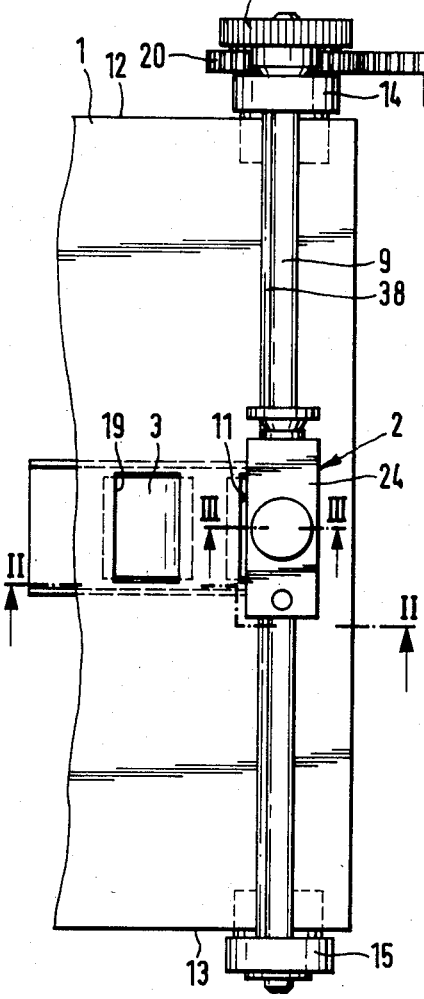
Fig. 10
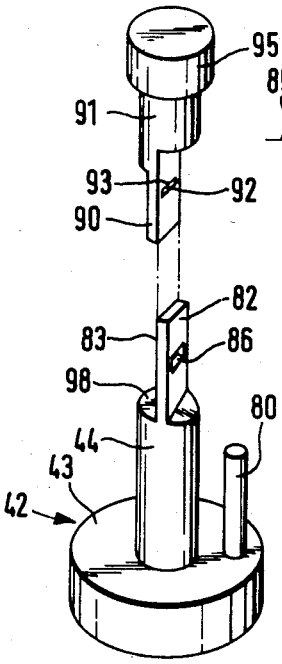
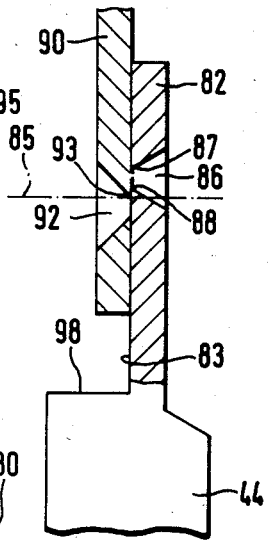
Fig. 11

SHEET SEPARATOR INCLUDING PASSAGE GAP ADJUSTING MECHANISM FOR SEPARATING SHEETS OF VARIOUS THICKNESSES FROM A STACK OF SHEETS

FIELD AND BACKGROUND OF THE INVENTION

The present invention relates in general to sheet feeding equipment and in particular to a new and useful sheet separator for sheet feeders, which includes a mechanism for regulating and adjusting the passage gap between a retaining member for holding back sheets in the stack, and a friction cylinder which is rotatable for feeding one sheet from the stack.

Such sheet feeders are known per se. There are sheet feeders having their retaining member rigidly fixed in its adjusted position, thus defining a passage gap which cannot be changed up to the next adjustment (German patent No. 1,261,132). In other sheet feeders (German OS No. 25 38 957), the radial spacing however, after an adjustment, the member is displaceable against a spring actin so as to enlarge the passage gap. While designs with fixed retaining members start from the assumption that the paper sheet thickness within a single stack is constant, within usual tolerances, designs with a resiliently mounted retaining member provide a possibility of handling sheets of varying thicknesses within a single stack, with the requirement, however, of initially adjusting the minimum sheet thickness.

In neither of these kinds of feeders, however, can the paper passage gap be adjusted exactly with certainty, since no proper measuring and indicating equipment is provided. In prior art feeders, while adjusting the passage gap to a certain paper thickness, initially, the sheet is inserted into a larger gap and with the friction cylinder at a standstill. Then, the gap is narrowed by correspondingly readjusting the retaining member, until, with the friction cylinder remaining at a standstill, the sheet can be moved between this cylinder and the retaining member only under considerable frictional resistance. The adjustment thus depends on the feeling of the adjuster, and it is particularly critical, i.e. uncertain, with thin paper, since there is no absolute measure of accuracy in this regard.

SUMMARY OF THE INVENTION

The present invention is directed to an elimination of this drawback and to a feeder of the above-mentioned kind permitting an accurate adjustment of the passage gap to any paper sheet thickness, by means of an objective measuring method and in a quality which is reproducible.

Accordingly an object of the present invention is to provide a sheet separator for a sheet feeder, comprising a friction cylinder, drive means for rotating the friction cylinder, a retaining member mounted for radial movement relative to the friction cylinder and provided with a braking surface having a coefficient of friction and forming with the friction cylinder a passage gap which is adjustable to the thickness of a sheet to be separated. A carrier is connected to the retaining member for supporting the retaining member. A bracket is mounted for radial movement on the carrier, relative to the friction cylinder and the retaining member. The bracket has a contact surface which can apply against the friction cylinder or against a sheet of paper held between the friction cylinder and the retaining member. A checking element is movably mounted to the bracket and engaged with the carrier and retaining member. A signal switch is associated with the checking element for changing its switching state when a selected position of the retaining member relative to the contact surface is reached, which position corresponds to a selected width of the passage gap. A switching circuit is connected to the signal switch for indicating its change in state.

With such a device, even persons without experience in paper sheet feeding are able to easily adjust the passage gap exactly to any desired sheet thickness. The handling may simply be such, that a sheet having the thickness to be adjusted is inserted into the paper gap, then the contact surface of the bracket is lowered into contact with the inserted sheet, so that the spacing between the contact surface and the friction cylinder exactly corresponds to the paper thickness, and finally the retaining member is readjusted until the signal switch responds and the signal circuit actuates an indicator, such as a light.

It is possible to position the signal switch on the bracket at a fixed distance from the contact surface. However, it is advantageous to provide the signal switch with a contact or a switching element whose position relative to the contact surface of the bracket is adjustable and whose associated opposite contact is connected to the checking element. This makes it possible to adjust or readjust the setting accuracy of the gap and to comply with existing conditions.

According to another feature of the invention, the signal switch is electrical and includes a contact or switch element whose position in the bracket relative to the contact surface is adjustable and with an opposite element which is connected to the checking element and movable therewith. The contact and opposite element touch to place the switch in one conductive state, and are moved apart to place the switch in another non-conductive state.

According to a very simple, inexpensive and reliable embodiment of the invention, the contact element comprises a contact pin which is adjustable in the bracket in the radial direction with respect to the friction cylinder or with respect to the contact surface. The checking element comprises an opposite contact pin which is received and guided for displacement in a bore of the bracket, coaxial with the contact pin. The checking element is urged by means of a spring into direct contact with a retaining member.

To ensure that at every adjustment, the contact surface will be applied against the friction cylinder with the same force, the bracket is biased by means of springs radially toward the friction cylinder.

Another object of the present invention is to provide such a sheet separator wherein the bracket comprises a substantially U-shaped body which is made of plastic and has two parallel legs straddling the retaining member and guided for displacement on the carrier. The U-shaped body includes a block-like bridging portion connected between the parallel legs in which the signal switch is accommodated with the contact surface defined on surfaces of the legs remote from the briding portion.

Due to this design, an advantage is obtained in that the contact surface is divided into two separate portions at different sides of the retaining member which ensures that the bracket will always be in correct sensing position relative to the friction cylinder and retaining member.

Another object of the invention is to provide a sheet separator which includes a manually operable locking bolt which is movably mounted in the bracket and movable into a position for holding the contact surface away from the friction surface and for freezing the operation of the signal switch.

This offers the advantage that the contact surface, or the two portions thereof, will not disturb the normal sheet separating and feeding function. The bracket and switch can be unlocked for use in adjusting the gap but held back in its arrested position at other times.

According to another feature of the invention, a standby switch is provided in one of the parallel legs or at another part of the bracket which contains the contact surface, the bypass switch being actuated by engagement with the friction cylinder.

With an additional standby switch in such a position, the signal circuit and the signal switch will be ready for operation, i.e. under voltage, only with the bracket unlocked and the contact surface applied against the friction cylinder. The standby switch may further be employed for making a signal lamp respond, for example, to keep it light until the bracket comes into the contact position in which the retaining member can be adjusted with the aid of the signal switch to the desired passage gap.

According to another feature of the invention, the bypass switch is provided in one of the parallel legs and includes a contact pin which opens the switch when it engages the friction cylinder.

This arrangement is not only most advantageous to the function of the standby switch but also best in safety terms, since at this location, at risk of an unintentional actuation of this swtich is minimized.

According to another object of the invention, the checking element of the sheet separator comprises a shank which has a shoulder face that is guided for displacement in a bore of the bracket which extends in the bridging portion of the bracket radially of the friction cylinder. The locking bolt comprises a rod which is axially movable in a cross bore through the bracket and into the path movement of the checking element shank. The checking element shank forms one contact of the signal switch and can be held back by the bolt in a position away from the other contact of the switch.

In this way, the locking structure can be made simple and inexpensive, and an advantageous locking of the bracket in its position lifted from the friction cylinder can be obtained, since the checking element actuating the signal switch then occupies, relative to the signal switch, another position in locked state than in its unlocked state where the bracket applies against the friction cylinder or a sheet in the gap.

If the rod embodying the locking bolt is accommodated in the bracket so as to cooperate with the front face of the shank of the checking element and this face is at the same time a contact surface of the signal switch, it is advantageous to make the rod, or at least its front end for coming into contact with said front face, of a plastic or provide it with a plastic coating, to have the switch open, i.e. interrupted, in the locked position of the bracket.

In its most simple embodiment with mechanical contacts, the switch may exhibit a satisfactory accuracy in adjustment and reliability in operation. If even greater accuracy is required a light barrier is used as the signal switch for the sheet separator. The checking element forms one part of a light stop and carries a cavity which can be aligned with a cavity of another part of the light stop which is fixed to the bracket at an adjustable position. A light source and an opto-electrical switching element are provided on opposite sides of the light stop to complete the light barrier switch.

While with mechanical contact switches, as is well known, the risk is run of having to deal later with contact resistances caused by oxidation, for example, or with a slight deformation of the contacting surfaces, unfavorably affecting the accuracy of adjustment, light barrier swiches do not have these drawbacks.

According to a still further feature of the invention, the light stop is formed by two flat members which have surfaces that slide against each other nad which each include a slotlike aperture. Each aperture has at least one straight boundary edge which extends transversely to the direction of motion of the checking element. One flat member is connected to the checking element, while the other flat member is fixed to the bracket at an adjustable location. This ensures a very high accuracy in adjustment with simple means, and a setting and control arrangement capable of operating for a long time without trouble.

To make it easy for an operator to reliably recognize the precise position for the retaining member relative to the friction cylinder, another feature of the invention provides a light source in the switching circuit which is positioned at a highly visible location and which lights when the signal switch changes state.

It is irrelevant and raises no technical problems whether the signal circuit, when the correct position is obtained, switches the light on or off.

Since sheet feeders in which the setting shaft carries an eccentrically mounted retaining member in the form of a braking cylinder made of corundum or a polyurethane, having proved to be best a long time ago, and the invention is to be applicable also to feeders of that kind, another development of the invention provides that in such instances the checking element is resiliently applied against the eccentric braking cylinder at a location opposite from the sheet passage gap.

A still further object of the invention is to provide such a sheet separator which includes a carrier that has a rectangular cross section and is movable in a slot in the bracket. In this way the bracket is prevented from rotating with respect to the carrier but still can move radially with respect to the friction cylinder. In this way, no additional means are necessary to stabilize the position of the bracket relative to the carrier.

A particularly favorable embodiment of the invention utilizes a substantially block-shaped hollow body as the retaining member, with a substantially rectangular cavity therein for receiving the carrier. The height of the cavity is greater than the height of the carrier while the side walls of the cavity engage side walls of the carrier. In this way, the hollow body acting as the retaining member can be moved radially with respect to the friction cylinder for adjusting the passage gap therebetween.

Another advantageous feature of the invention utilizes a threaded spindle which is threaded in a tapped hole in the carrier and which is connected to the retaining member for adjusting the relative position between the carrier and the retaining member to adjust the passage gap. Particularly if the spindle and the hole are provided with a fine thread, a high precision adjustment of the retaining member is obtained in a simple way.

The threaded spindle may be provided with a knurled head which can be manually rotated for adjusting the passage gap. The knurled head may be provided with an arresting mechanism so that it can be held in place or, with the arresting mechanism released, the threaded spindle can be rotated. The checking element can be resiliently supported for movement in the bracket in engagement with the knurled head which is provided with a cambered cap for this purpose.

A further object of the invention is to provide a sheet separator for a sheet feeding machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the following, several embodiments of the invention are explained in more detail with reference to the drawings in which:

FIG. 1 is a top plan view of a feeder;

FIG. 2 is a sectional view taken along the line II—II of FIG. 1;

FIG. 10 is an exploded view of the parts of a light stop for a light barrier;

FIG. 11 is an enlarged sectional view of the light stop;

DESCRIPTION OF THE PREFERRED EMBODIMENTS

Figure 3:
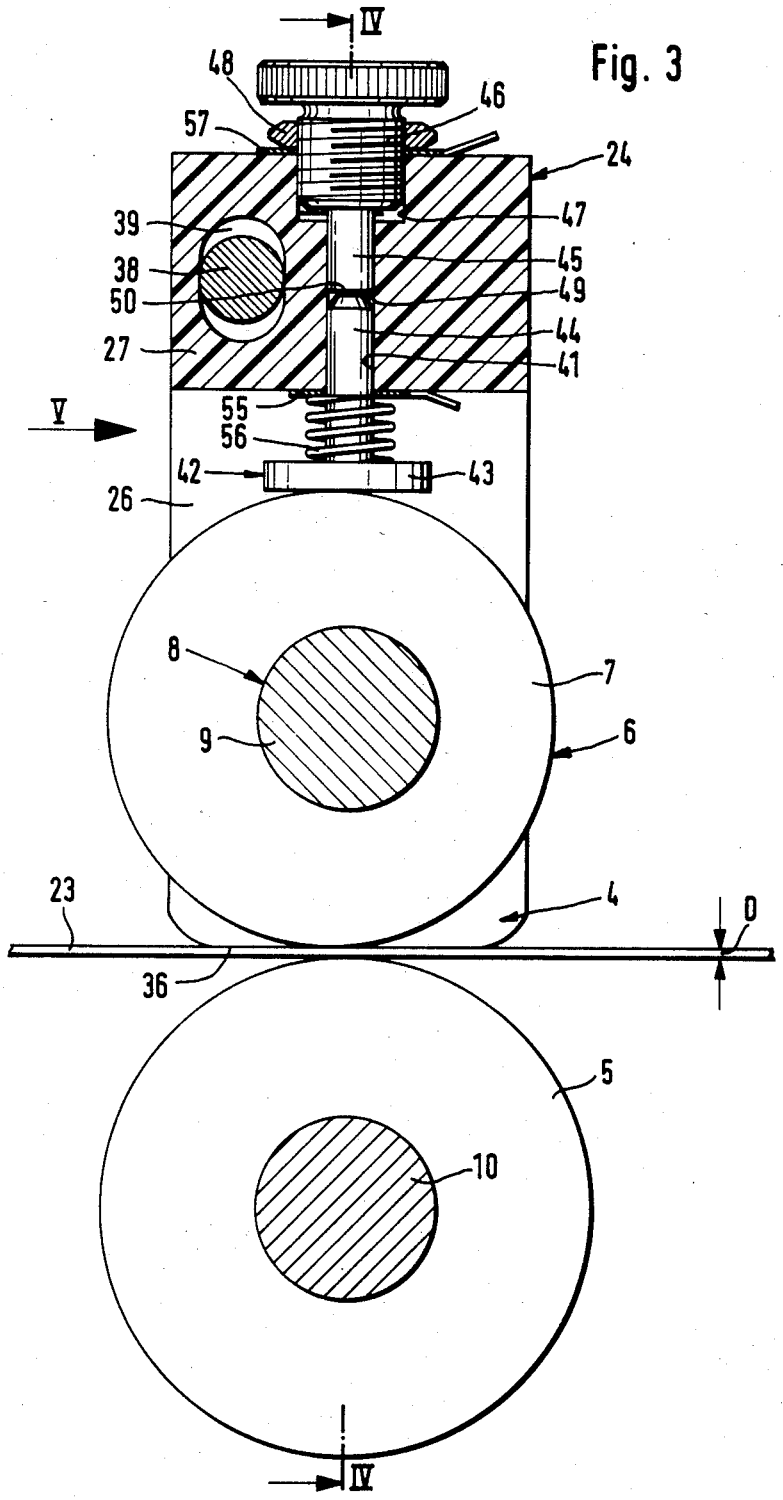
FIG. 3 is an enlarged sectional view taken along the line III—III of FIG. 2 showing the sheet separator.

The sheet feeder 2 shown in FIGS. 1 and 2 in connection with a feed table 1, substantially comprises a feed roller 3 and a sheet separator 4. The sheet separator includes a friction cylinder 5 and a retaining member 6 which is mounted over a top surface of the feed table. In the embodiment of FIGS. 1 to 9, the retaining member 6 comprises a braking cylinder 7 which is disposed centrally above the friction cylinder 5, and is eccentrically and non-rotatably mounted on a setting shaft 9 serving as a carrier 8. Friction cylinder 5 is non-rotatably mounted to a drive shaft 10, centrally of the table, and protrudes through a slot 11 provided in feed table 1. Drive shaft 10 extends to both sides beyond the side edges 12,13 of the table and is at either side supported for rotation in a bearing bracket 14, 15. Cylinder 5 thus co-rotates with shaft 10. Setting shaft 9 also is mounted for rotation in these brackets 14, 15 but can be fixed in position, to be able to move braking cylinder 7, which is eccentrically supported thereon, in one or the other direction and at least approximately radially relative to the friction cylinder 5, and thus to adjust the passage gap formed between braking cylinder 7 and friction cylinder 5 to a definite sheet thickness D. By frictional interengagement and through a friction roller 17, feed roller 3 is operatively connected for rotation with friction cylinder 5 and driven by this cylinder in the same direction. Feed roller 3 which, together with friction roller 17 and friction cylinder 5, is accommodated in a housing 18 provided beneath feed table 1 protrudes partly upwardly through a slot 19 so that it is capable of engaging every lowermost sheet of a stack placed on the feed table and feeding it to the separator 4 where the sheet is engaged by friction cylinder 5 and advanced. On the end portion of drive shaft 10 protruding from bearing bracket 14, a gear 20 is secured meshing with another gear 21 which is mechanically driven through a transmission of a paper treating machine (not shown). Setting shaft 9 is provided with a turning knob 22. Friction cylinder 5 is driven continuously or intermittently, depending on the machine to which the sheets are to be fed.

Since driving shaft 10 and setting shaft 9, extending parallel to each other, are supported in the same bearing brackets 14, 15, their mutual spacing is fixed, and since braking cylinder 7 is secured thereto eccentrically, a rotation of setting shaft 9 within an angular sector of 180° varies the gap 16 between the cylindrical surfaces of braking cylinder 7 and friction cylinder 5. This forms gap adjusting means for this embodiment of the invention.

To be able to adjust this gap 16 exactly to the thickness D of a sheet 23 to be removed from a stack, and to make sure that always only a single sheet will be advanced through the gap thus adjusted, sheet separator 4 is equipped with a signalling device which is described in the following.

Mounted on setting shaft 9 is a U-shaped bracket 24 having two legs 25,26 by which the retaining member 6, namely braking cylinder 7, is straddled and which are integral with a substantially rectangular bridging portion 27. The entire bracket 24 is made of a plastic, so that it is electrically non-conducting. Setting shaft 9 extends through oblong holes 28, 29 provided in the two legs 25, 26, so that bracket 24 can be radially displaced by a certain distance relative to friction cylinder 5. Tension springs 32, 33 extend in lateral recesses 30, 31 of legs 25, 26, and are attached to pins 34, 35 and trained about setting shaft 9, to pull bracket 24 toward friction cylinder 5. The two end surfaces 36,37 facing friction cylinder 5, of legs 25, 26 form the contact surface by which bracket 34 applies against a sheet 23 passing through gap 16 and having a thickness to which the gap is adjusted.

Since setting shaft 9 is cylindrical and the position of bracket 24 would not be stable, a bracing rail 38 is provided which extends through an oblong hole 39 provided in the bracket (FIG. 3) and is secured to the two bearing brackets 14, 15.

In the middle of bridging portion 27 of bracket 24, a bore 41 is provided which extends at least substantially radially to the axis 40 of setting shaft 9 and serves as a guideway for a checking element 42 which is movable up and down and comprises a disc-shaped lower portion 43 and a cylindrical shank 44. In the upper portion of bore 41, a cylindrical pin 45 is received forming a part of a set screw 46. Set screw 46 is screwed into a tap hole 47 which is coaxial with bore 41, and secured by a lock nut 48. The lower end face 49 of pin 45 and the upper end face 50 of shank 44 serve as electrical contact surfaces of a signal switch 52 (FIG. 7) which is connected in the signal circuit 51. Signal circuit 51 includes an electrical light source 53 which is accommodated in a corresponding recess 54 of bracket 24. Between the disc portion 43 of checking element 42 and a washer 55 applied against the underside of bridging portion 27 and surrounds shank 44, a compression spring 56 is provided by which checking element 42 is held in permanent contact with retaining member 6, namely with the cylindrical surface of braking cylinder 7. A washe 57 is also provided between lock nut 48 and the upper surface of bracket 24 around bore 47. The two washers, 55 and 57 form connections for the electrical lines 58, 59 of a signal circuit (and power supply) 51. In the lower end portion of leg 26 of bracket 24, an electrical standby switch 60 of the make-contact type is provided whose contact member 61 protrudes from the end surface 37 as long as this face does not apply against a sheet 23 or against the cylindrical surface of friction cylinder 5, thereby holding the switch 60 in open position. However, as soon as end surface 36 and 37 are lowered onto a sheet 23 or the friction cylinder 5, standby switch 60 is closed by its contact member 61 so that signal circuit 51 is brought into a standby position which it can be controlled by signal switch 52 which is formed by the two contact elements 44 and 45.

If it is desired to adjust passage gap 16 of sheet separator 4 to a certain paper quality, i.e. to a certain sheet thickness, braking cylinder 7 is adjusted to a larger passage gap than would correspond to a sheet 23, bracket 24 is lifted, and the sheet is inserted into the gap. Then, bracket 24 is released so that it is pulled by springs 32, 33 against sheet 23, and end faces 49,59 are brought into contact so that signal switch 52 is closed. Thereupon, as soon as standby switch 60 is also closed, light 53 lights up. This is the case as long as the braking cylinder does not apply against the inserted sheet 23. If now, braking cylinder 7, i.e. the retaining member 6, is pivoted downwardly by correspondingly turning setting shaft 9, until the cylindrical surface thereof as well as the two contact surfaces 36,37 apply against sheet 23, at the instant at which this contact is established, the contact between end faces 49 and 50 is interrupted, so that light 53 goes off. This gives the adjustor a clean signal that retaining member 6 has come into its correct position relative to friction cylinder 5, corresponding to the sheet thickness. In this connection, the distance a (FIG. 4) between the lower end face 49 and the common plane of the two contact surfaces 36,37 may be provided by 0.01 to 0.02 mm larger than the sum of the diameter of braking cylinder 7 and the axial length of checking element 42. The accuracy of adjustment within the region of 0.01 to 0.02 mm is then independent of the sheet thickness. It is important in this regard to have both the contact surfaces 36, 37 applied against the inserted paper sheet by the same force, which is satisfactorily ensured by the two tension springs 32,33.

Figure 6:
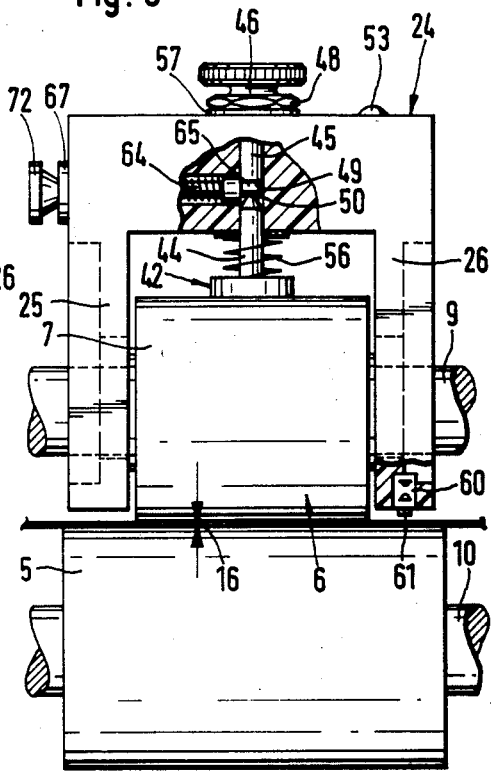
FIG. 6 is the same view as FIG. 5 with the parts in different position.
Figure 7:
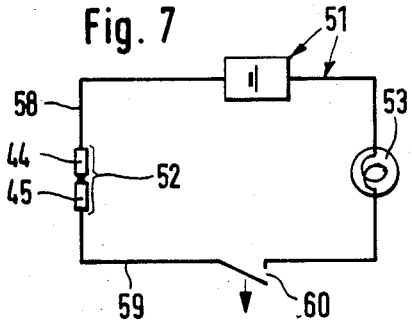
FIG. 7 is a block diagram of the signal circuit.

To be able, after adjusting passage gap 16, to lift bracket 24 in the direction of arrow 62 and lock it in the position shown in FIG. 6, an axially movable locking rod 64 is provided which is received in a cross bore 63 extending radially to bore 41. Cross bore 63 is so disposed that the front end portion 65 of rod 64 can be shifted between the two end faces 49,50, when the two end surfaces 36,37 are lifted relative to the passage gap by a distance corresponding to the diameter of the front end portion 65. This portion 65 thus represents a locking bar with which bracket 64 can be fixed in a position with surfaces 36, 37 lifted from the passage gap, It is advantageous to make rod 64 of a plastic, or at least coat its end portion 65 with a plastic, so that end face 49, 50 have no electrical contact with each other in the locked position shown in FIG. 6.

To guide rod 64 radially in cross bores 63, a piston-like flange 66 is provided, and the opposite end is guided in a bushing 67. A helical compression spring 68 may be inserted between flange 66 and bushing 67, so that upon lifting bracket 74 in the direction of arrow 62, the rod comes automatically into its locked position shown in FIG. 6. To be able to arrest it also in the non-locked position shown in FIG. 4, the rod is provided with a cross pin 69 which can engage axial grooves 70 and 71 of bushing 67 only in a certain angular position of the rod. The rod can be handled for this purpose by means of knob 72.

In the embodiment of FIGS. 8 to 12, a light barrier is provided as a signal switch instead of a mechanical contact switch. The light barrier is formed by an electrical light source 76 and an opto-electrical switching element 77, and is controlled by a slot-type light stop 78. Light source 76 and switching elements 77 are provided in opposite sides of light stop 78, in a throughgoing cross bore 79 of bracket 24' which is designed which will be explained hereinafter, and also operates in the same manner.

In this embodiment, a bore 41 radially extending to the axis of shaft 9, is provided in bridging portion 27', in which cylindrical shank 44 of checking element 42 is guided for axial movement. As in the embodiment of FIGS. 3, 4, shank 44 is joined at its bottom to a disc-shaped part 43 which is applied against braking cylinder 7 through compression spring 56. By means of an eccentric pin 80, which projects into a blind bore 81 of bridging portion 27', shank 44 is prevented from rotating about its own axis. The upper end projecting into cross bore 79 is designed as a flat portion 82 having one of its boundary surface 83 extending in the central axis 84 of bore 41, transversely to the light barrier axis 85. Flat portion 82 is provided with a tapering slto 86 whose limiting edges 87,88 extend exactly at right angles to axis 84 of bore 41. Flat portion 82 is integral with shank 44 and forms the movabel member of light stop 78. The fixed member of the light stop is formed by a flat portion 90 snugly applying against the planar surface 83 of flat portion 82, of a partly semicylindrical pin 91 which is guided in the upper portion 41' of bore 41. This flat portion 90 also is provided with a tapering slot 92 whose upper limiting edge 9 again is exactly perpendicular to axis 84 of bore 41 and extends at the level of light barrier axis 85. To make possible an axial adjustment of pin 91 while preventing pil 91 from turning, a set screw 46' is provided having a cylindrical recess 94 into which pin 91 protrudes. On its upper end applying against the bottom of recess 94, pin 91 is provided with a flange 95 to which a compression spring 96 is applied whose other end bears against the lower surface of bore 47. Set screw 46' also is secured by a lock nut 48.

Figure 9:
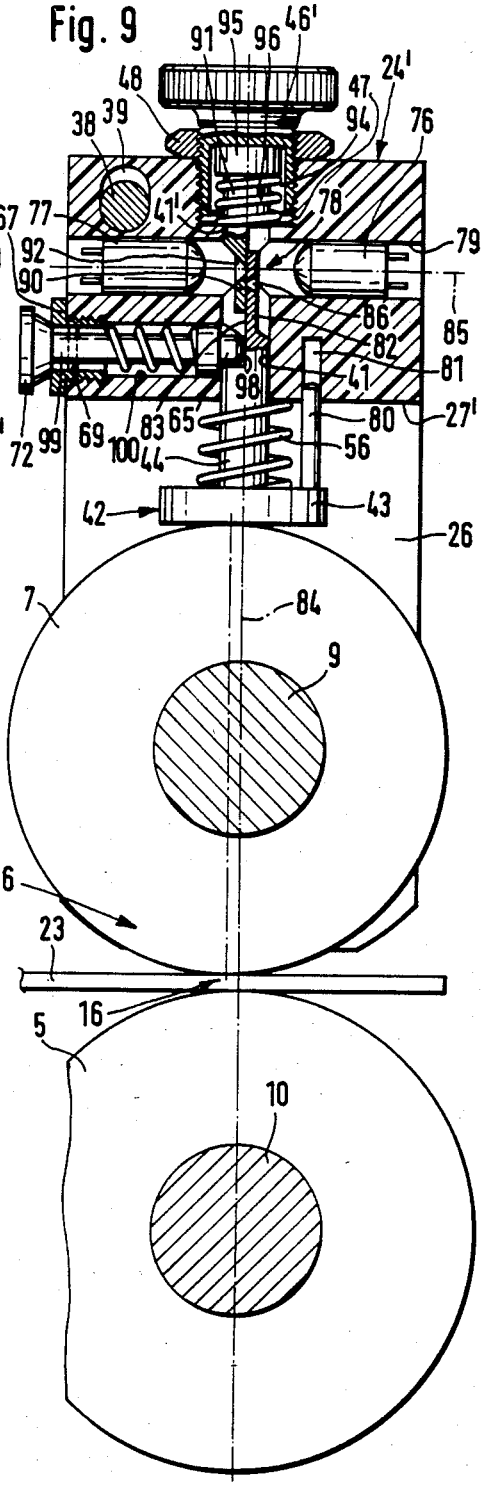
FIG. 9 is a similar view to FIG. 8 showing the parts in different position.

To lock bracket 24' in its position shown in FIG. 9, lifted from passage gap 16, a radial shoulder 98 of shank 44 is utilized in connection with a rod 99 serving as a locking bar. Rod 99 is received for displacement in a cross bore 100. It differs from rod 65 of FIGS. 3 to 6 only in its length. While rod 99 of FIG. 8 occupies its inoperative position, its front portion protrudes, in the position shown in FIG. 9, as a locking element over radial shoulder 98 and prevents bracket 24' from dropping into the position shown in FIG. 8 in which contact surfaces 36,37 extend in the plane of gap 16 or apply against a sheet 23 inserted in the gap.

Figure 12:
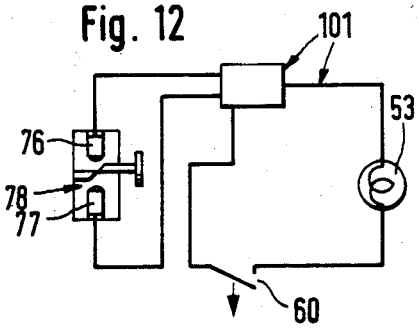
FIG. 12 is a block diagram of the signal circuit controlled by the light stop.
Figure 8:
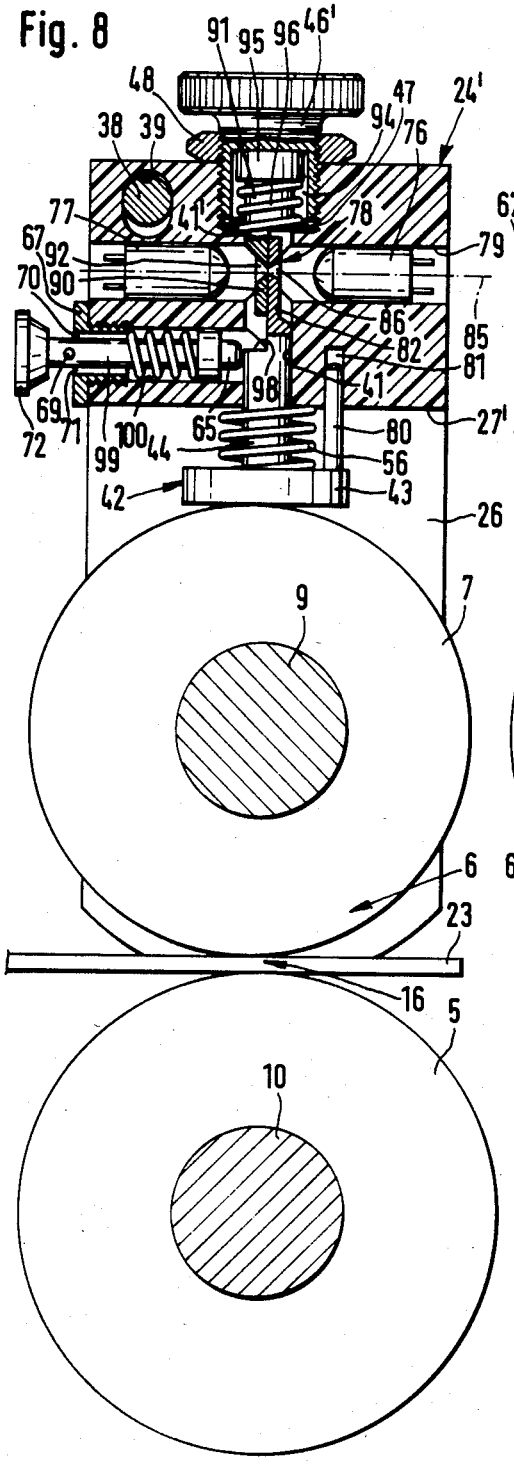
FIG. 8 is a sectional view showing another embodiment of the sheet separator.

As shown in FIG. 12, the switching element of light barrier 76,77 which is controlled by light stop 78 is connected to a circuit (and power supply) 101 by which a light source 53 is controlled in response to the position of standby switch 60.

Figure 4:
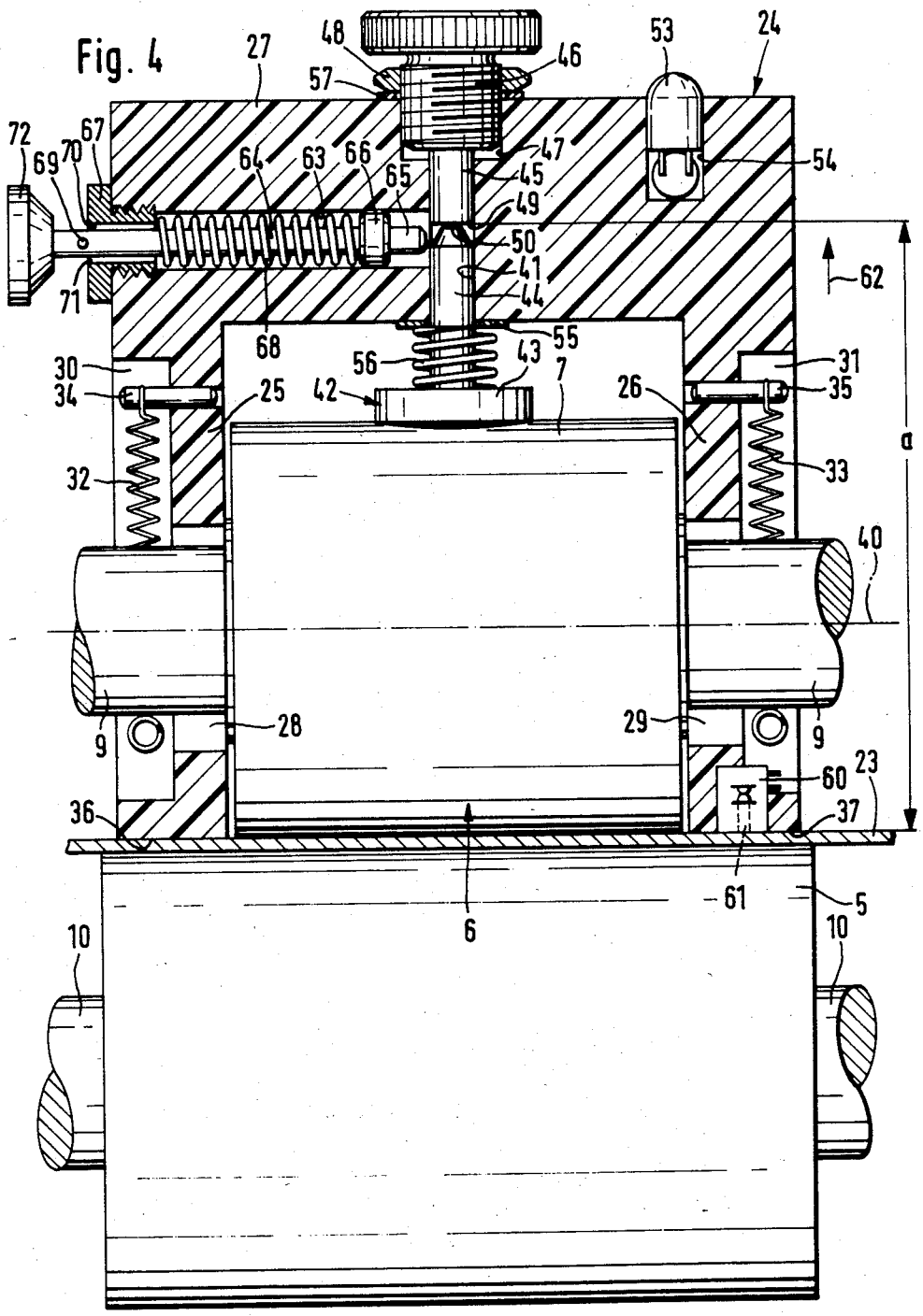
FIG. 4 is a sectional view taken along the line IV—IV of FIG. 3.
Figure 5:
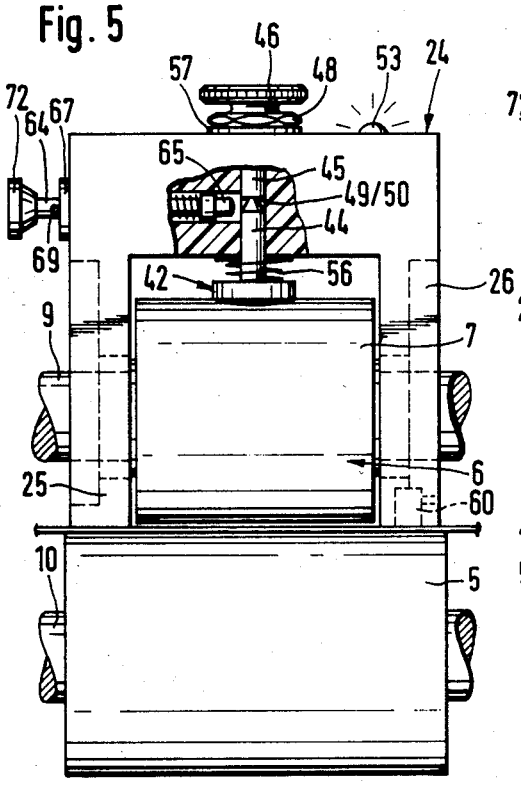
FIG. 5 is a side view corresponding to FIG. 3.

To adjust gap 16 to a sheet thickness, the procedure is the same as with the embodiment of FIGS. 4 to 6. First, after inserting a sheet into the wide open gap 16, by pulling and turning rod 99, bracket 24' and shank 44 are unlocked from each other. Thereupon, bracket 24' is lowered until contact surfaces 36,37 apply against sheet 23. As long as gap 16 is larger than the inserted sheet, the light stop remains closed. By turning setting shaft 9, as soon as braking cylinder 7 comes into contact with sheet 23 by its surface portion diametrally opposite to checking element 42, light stop 78, due to the simultaneous lowering of checking element 42, is opened to an extent permitting the light beam to pass through light stop 78 to make light source 53 respond and thus to produce an optical signal indicating that gap 16 has been adjusted to the thickness of the inserted sheet.

Bracket 25 may then be lifted again to its position shown in FIG. 9 and locked by rod 99.

Figure 13:
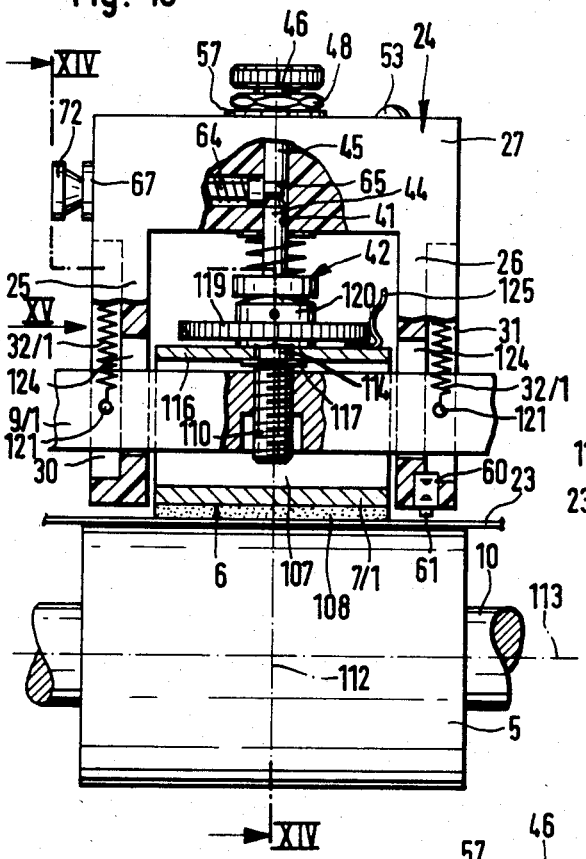
FIG. 13 is a partly sectional front view of another embodiment of the feed separator.
Figure 14:
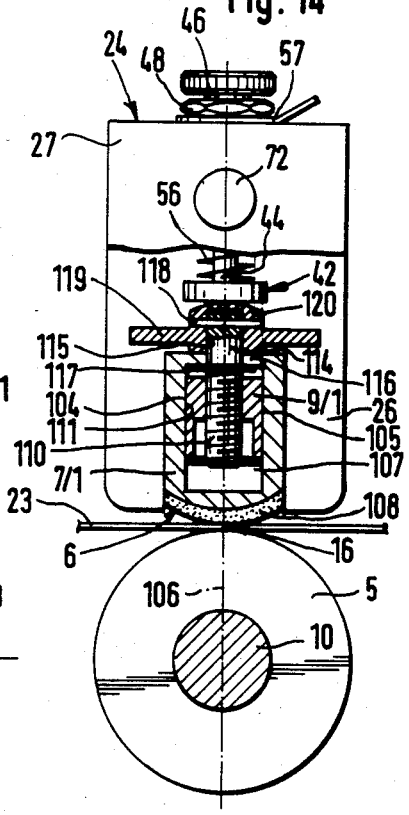
FIG. 14 is a sectional view taken along the line XIV—XIV of FIG. 13.
Figure 15:
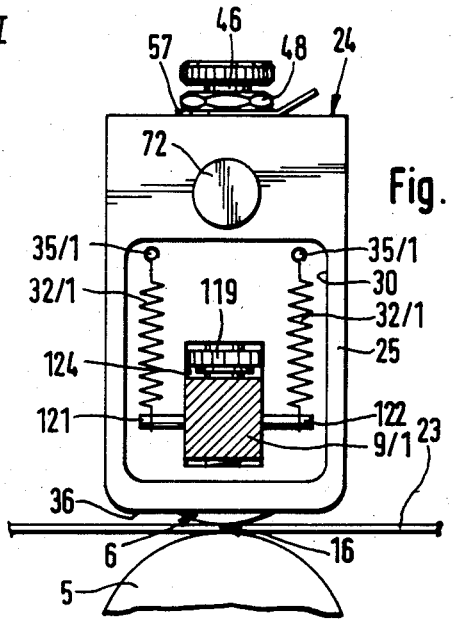
FIG. 15 is a partial view of the sheet separator of FIG. 13.

In the sheet separator shown in FIGS. 13, 14 and 15, the retaining member 6 is not embodied as a braking cylinder 7, but is designed as a rectangular hollow body 7/1, and the carrier is not embodied as a cylindrical shaft 9, but is designed as a fixed rail 9/1 having a rectangular cross section and being non-rotatably secured to the two bearing brackets 14, 15 (FIG. 1). The side surfaces 104,105 or rail 9/1 extend parallel to the medium plane 106 of both rail 9/1 and friction cylinder 5. The rectangular cavity 107 of hollow body 7/1 is open on both front sides and its width corresponds to that of rail 9/1, while its height is by some millimeters larger than the height of the rail. Rail 9/1 thus extends through hollow body 7/1 with a fit such that the body cannot rotate relative to the rail, yet it can move radially to augment or reduce its distance from friction cylinder 5. The side facing friction cylinder 5 of hollow body 7/1 is circularly cambered and provided with a frictional lining 108 whose outer surface forms the gap 16 with friction cylinder 5. To be able to adjust hollow body 7,7/1 relative to rail 9/1 and thus to friction cylinder 5 continuously, a threaded spindle 110 is provided which is screwed into a tap hole III of rail 9/1 and show axis 112 forms a right angle with the axis 113 of friction cylinder 5. On its upper end, spindle 110 is provided with a cylindrical shank 114 which extends through a cylindrical bore 115 in upper wall 116 of hollow body 7/1 and carries a retaining washer 117 supporting this upper wall. To the end portion protruding from wall 116 of shank 114, a knurled head 119 is secured by means of a cross pin 118, which is supported on the top of wall 116 and is provided at the opposite side with a cambered cap 120 by which shank 114 is embraced and on which the checking element 42 of bracket 24 is resiliently supported. Bracket 24 is designed and arranged identically with that of the embodiment of FIGS. 3 to 6. Only, instead of tension springs 32,33 trained around setting shaft 9, two tension springs 32/1, 32/2 are provided in each of the legs 25,26 of bracket 24 which are suspended from pins 35/1 of legs 25,26 and, on the other side, from pins 121, 122 of rail 9/1.

In this embodiment, retaining member 8 can be adjusted relative to rail 9/1, thus to friction cylinder 5, by correspondingly turning spindle 110 by means of knurled head 119, with spindle 110, knurled head 119, and checking element 42 executing the same movements as the retaining member 6 embodied by hollow body 7/1. To obtain the high accuracy adjustment, it is advisable to provide spindle 110 and hole 111 with fine threads.

The operation and handling is the same as according to FIGS. 3 to 7. The embodiment of FIGS. 13 to 15, has the particular advantage that the otherwise needed bracing rail 38 can be omitted, since legs 25,26 are provided with rectangular recesses 124 for rail 9/1 and the sides of the recesses fit the sides of the rail, so that bracket 24 is fixed in a position for correct operation. On the top of hollow body 7/1, a shaped spring element 125 is provided which engages the knurling of the knurled head 119 and thus secured the head against unintentional turning.

While specific embodiments of the invention have been shown and described in detail to illustrate the application of the principles of the invention, it will be understood that the invention may be embodied otherwise without departing from such principles.

What is claimed is:

1. A sheet separator for a sheet feeder, comprising: a friction cylinder; drive means for rotating said friction cylinder; a retaining member mounted for radial movement relative to said friction cylinder and provided with a braking surface having a high coefficient of friction and forming with said friction cylinder a passage gap which is adjustable to the thickness of a sheet to be separated; a carrier connected to and supporting said retaining member; gap adjustment means connected to said carrier and said retaining member for adjusting a width of the passage gap; a bracket mounted on said carrier and movable radially relative to said friction cylinder, said bracket having a contact surface which can be applied in said passage gap against said friction cylinder; a checking element movably mounted to said bracket and engaged with said retaining member; a signal switch associated with said checking element for changing its switching state at a selected position of said retaining member relative to said contact surface; and a switching circuit connected to the signal switch for indicating its change in switching state.

2. A sheet separator according to claim 1, wherein said signal switch comprises an electrical signal switch including a first contact connected to said bracket at an adjustable location, first contact adjusting means connected to said bracket for adjusting the fixed position of said first contact, and a second contact conected to said checking element and movable with said checking element, one switching state of said signal switch being established with contact of said first and second contacts and another switching state of said signal switch being established with said first and second contacts being spaced apart.

3. A sheet separator according to claim 2, wherein said bracket includes a bore extending radially therein with respect to said friction cylinder, said first contact comprising a first contact pin mounted in said bore at an adjustable fixed position, said second contact comprising a second contact pin connected to said checking element and movable in said bore toward and away from said first contact pin, and a spring engaged with said second contact pin for urging said checking element into direct engagement with said retaining member.

4. A sheet separator according to claim 1, including biasing means connectd between said bracket and said carrier for urging said bracket toward said friction cylinder.

5. A sheet separator according to claim 1, wherein said bracket comprises a U-shaped body made of non-electrically conductive material, said body having a pair of spaced apart parallel legs straddling said retaining member and a blocklike briding portion connecting said legs together, said checking element being movable in said bridging portion and said signal switch disposed in said briding portion, said parallel legs each having a surface remote from said bridging portion which forms said contact surface.

6. A sheet separator according to claim 1, including locking means movably mounted to said bracket and manually operable for engaging and disengaging a portion of said checking element for holding said contact surface in a position away from said friction cylinder with said locking means engaged with said checking element, said locking means also engaging said signal switch for arresting said signal switch in one of its states.

7. A sheet separator according to claim 1, including a standby switch connected to said bracket and having an actuating member disposed in said contact surface of said bracket for actuating said standby switch when said actuating member engages said friction cylinder, said standby switch connected to said switching circuit for enabling the influence of said signal switch on said circuit.

8. A sheet separator according to claim 7, wherein said bracket comprises a U-shaped body made of plastic and having two parallel legs connected together by a briding portion, said checking element and said signal switch carried by said bridging portion, said standby switch comprising a closing-contact switch mounted in one of said legs and having an opening switching position when said actuating member projects out of said contact surface and a closed position when said actuating member is moved to a position corresponding to said contact surface.

9. A sheet separator according to claim 1, wherein said bracket includes a radial bore therethrough, said checking element having a shank with a shoulder face forming one contact of said signal switch, said signal switch having another contact at an adjustable fixed position in said bore, said bore extending radially with respect to said friction cylinder, said bracket including a cross bore crossing said first mentioned bore, a locking bolt movably mounted in said cross bore and movable into a position engaging said shank for holding said contacts apart and for holding said bracket in a radial position with its contact surface away from said friction cylinder.

10. A sheet separator according to claim 1, wherein said signal switch comprises a light barrier switch, said bracket having a cavity, said light barrier switch having a light stop comprising a fixed portion connected at an adjustable position in said cavity and a portion of said checking element movable in said cavity, a light source on one side of said light stop in said cavity and an opto-electrical switching element on an opposite side of said light stop in said cavity.

11. A sheet separator according to claim 10, wherein said fixed portion of said light stop comprises a flat member having a flat surface and a slot shaped aperture therein, said checking element including a flat portion having a flat surface engaged with said flat surface of said flat member and having a second slot-like aperture therein, said apertures each having at least one straight boundary edge extending transversely to a direction of movement of said checking element.

12. A sheet separator according to claim 1, wherein said switching circuit includes a light source having an on state and an off state, said light source changing states when said signal switch changes state, said light source mounted on said bracket at a clearly visible location thereon.

13. A sheet separator according to claim 1, wherein said retaining member comprises a braking cylinder eccentrically mounted to said carrier, said carrier comprising a setting shaft, biasing means engaged with said checking element for biasing said checking element against a surface of said braking cylinder on a side thereof opposite from said passage gap which is defined between said braking cylinder and said friction cylinder.

14. A sheet separator according to claim 1, wherein said carrier has a rectangular cross section, said bracket and said retaining member being mounted for radial movement to said carrier.

15. A sheet separator according to claim 14, wherein said retaining member comprises a block-shaped hollow body having a substantially rectangular cavity therein with side walls, a top wall and a bottom wall, said rectangular cross section carrier engaged in said cavity and having sides engaging with said said walls of said cavity and having a height less than a space inbetween said top and bottom of said cavity for permitting relative movement between said hollow body and said carrier, said hollow body having a cambered braking surface facing said friction cylinder.

16. A sheet separator according to claim 14, wherein said gap adjustment means comprises said carrier having a threaded hole therein, a threaded spindle engaged in said hole and connected to said hollow body whereby rotation of said spindle causes relative movement of said hollow body and said carrier, said spindle extending radially with respect to said friction cylinder.

17. A sheet separator according to claim 16, wherein said threaded spindle includes a knurled head disposed over said retaining member and a releasable arresting mechanism associated with said head for engaging and stopping rotation of said spindle and disengaging and permitting rotation of said spindle.

18. A sheet separator according to claim 17, including spring means engaged with said checking element for biasing said checking element against said knurled head, said knurled head including a cambered cap against which said checking element is engaged.

* * * * *